US009496103B2

(12) United States Patent
Han

(10) Patent No.: US 9,496,103 B2
(45) Date of Patent: Nov. 15, 2016

(54) NESTED KEY ASSEMBLY

(75) Inventor: Fei Han, Suzhou (CN)

(73) Assignee: Home Control SIngapore PTE. LTD., Toa Payoh (SG)

( * ) Notice: Subject to any disclaimer, the term of this patent is extended or adjusted under 35 U.S.C. 154(b) by 180 days.

(21) Appl. No.: 14/000,404

(22) PCT Filed: Mar. 7, 2012

(86) PCT No.: PCT/IB2012/051061

§ 371 (c)(1),
(2), (4) Date: Aug. 20, 2013

(87) PCT Pub. No.: WO2012/123855

PCT Pub. Date: Sep. 20, 2012

(65) Prior Publication Data

US 2014/0008197 A1 Jan. 9, 2014

(30) Foreign Application Priority Data

Mar. 14, 2011 (EP) ..... 11158062

(51) Int. Cl.
*H01H 9/26* (2006.01)
*H01H 13/72* (2006.01)
(Continued)

(52) U.S. Cl.
CPC ..... *H01H 13/705* (2013.01); *G05G 5/05* (2013.01); *H01H 25/002* (2013.01); *G05G 1/02* (2013.01); *H01H 2221/054* (2013.01); *H01H 2221/088* (2013.01)

(58) Field of Classification Search
CPC .. H01H 13/705; H01H 13/85; H01H 25/002; H01H 2221/054; H01H 2221/088; H01H 25/041; G05G 5/05; G05G 1/02
USPC ..... 200/5 A, 5 R, 6 A, 18, 341, 344, 345
See application file for complete search history.

(56) References Cited

U.S. PATENT DOCUMENTS 7,360,957 B2 4/2008 Dombrowski et al.
8,664,551 B2 * 3/2014 Nakajima et al. ..... 200/18
(Continued)

FOREIGN PATENT DOCUMENTS

CN 2710130 Y 7/2005
JP H-8-64066 A 3/1996
(Continued)

OTHER PUBLICATIONS

International Search Report for Int'l Application No. PCT/IB2012/051061, "Nested Key Assembly," date mailed Jun. 18, 2012.
(Continued)

*Primary Examiner* — Renee S Luebke
*Assistant Examiner* — Lheiren Mae A Caroc
(74) *Attorney, Agent, or Firm* — Hamilton, Brook, Smith & Reynolds, P.C.

(57) ABSTRACT

The invention relates to a nested key assembly (101) that can for example be used in a remote-control, a mobile phone or the like. In general, the key assembly comprises at least one inner-key (130; 140) surrounded by an outer-key (120; 130), wherein the inner-key (130; 140) comprises at least one flexible arm (132; 142) that extends below the outer-key (120; 130) and that directly or indirectly touches a carrier structure (110, 150). In a preferred embodiment, the key assembly comprises an "OK-key"(140) surrounded by a "cursor-key"(130), which in turn is surrounded by a "diamond-key"(120). The OK-key (140) comprises flexible arms (142) that extend below the cursor-key, while the cursor-key (130) comprises flexible arms (132) that extend below the diamond-key (120).

10 Claims, 3 Drawing Sheets

(51) Int. Cl.

| | |
|---|---|
| ***H01H 13/76*** | (2006.01) |
| ***H01H 13/705*** | (2006.01) |
| ***G05G 5/05*** | (2006.01) |
| ***H01H 25/00*** | (2006.01) |
| *G05G 1/02* | (2006.01) |

(56) References Cited

U.S. PATENT DOCUMENTS

| | | | | |
|---|---|---|---|---|
| 2002/0149566 | A1 | 10/2002 | Sarkissian | |
| 2005/0200598 | A1 | 9/2005 | Hayes et al. | |
| 2007/0057922 | A1 | 3/2007 | Schultz et al. | |
| 2007/0209921 | A1* | 9/2007 | Li et al. | 200/5 R |
| 2007/0257886 | A1* | 11/2007 | Uotani | G06F 3/0338 345/160 |
| 2007/0273671 | A1 | 11/2007 | Zadesky et al. | |
| 2007/0276525 | A1 | 11/2007 | Zadesky et al. | |
| 2011/0120849 | A1* | 5/2011 | Morimoto et al. | 200/5 A |

FOREIGN PATENT DOCUMENTS

| | | | |
|---|---|---|---|
| RU | 2364975 | C2 | 8/2009 |
| WO | WO 2012/123855 | A1 | 9/2012 |

OTHER PUBLICATIONS

Written Opinion of the Int'l Searching Authority for Int'l Application No. PCT/IB2012/051061, "Nested Key Assembly," date mailed Sep. 14, 2013.

Notification Concerning Transmittal of International Preliminary Report on Patentability for Int'l Application No. PCT/IB2012/051061, "Nested Key Assembly," date mailed Sep. 26, 2013.

* cited by examiner

NESTED KEY ASSEMBLY

CROSS-REFERENCE TO PRIOR APPLICATIONS

This application is the U.S. National Phase application under U.S.C. §371 of International Application No. PCT/2012/051061, filed on Mar. 7, 2012, which claims priority to EP11158062.7, filed on Mar. 14, 2011. These applications are hereby incorporated by reference herein.

FIELD OF THE INVENTION

The invention relates to a nested key assembly comprising at least two keys, wherein one key at least partially surrounds the other key. Moreover, it relates to an input device comprising such a key assembly.

BACKGROUND OF THE INVENTION

Nested key assemblies are used in many electronic devices, particularly in portable devices like mobile phones, music players, remote controls or the like. Typically, a nested key arrangement comprises a central button serving as an "OK-key" that is surrounded by a ring serving as a "cursor-key" for inputting directional information. The US 2007/0273671 A1 describes a nested key arrangement in which the central button is coupled via radially extending flanges to the surrounding key. Moreover, both keys are carried by switches that are disposed on a base plate.

SUMMARY OF THE INVENTION

It is an object of the present invention to provide a new design of a key assembly that can readily and cost effectively be manufactured and that has a high reliability during operation.

This object is achieved by a key assembly according to claim 1 and an input device according to claim 10. Preferred embodiments are disclosed in the dependent claims.

According to its first aspect, the invention relates to a key assembly, i.e. to a structure that comprises at least two keys which are separately and independently operable by a user and that is (or can be) integrated into some device, for example into a remote control, a mobile phone, a music player or the like. As the design of the key assembly is substantially independent of said device, the latter needs not be described or specified further in the context of the present invention. The key assembly comprises the following components:

- A first key which is operable by a user, i.e. which can be touched and pressed by a user with his/her finger or with an instrument (e.g. a pencil). The side of the first key that is accessible to the user will in the following be called "top side" for purposes of reference. Moreover, the first key will in the following be called "inner-key" with reference to function and its position relative to the key that is defined next.
- A second key, which will be called "outer-key" in the following. The outer-key is operable by a user from the top side and surrounds at least partially the aforementioned inner-key. Most preferably, the outer-key completely surrounds the inner-key, i.e. it is basically ring-shaped.
- A carrier structure relative to which the aforementioned keys shall be operable, i.e. movable. The outer-key is typically coupled to the carrier structure.

Furthermore, the inner-key comprises at least one flexible arm that extends below the outer-key and that directly or indirectly (i.e. via another, intermediate component) touches the carrier structure. In this context, the term "below" is to be understood with reference to the above mentioned top side, i.e. the flexible arm is disposed opposite to the top side and hence typically not accessible to a user. Moreover, "touching" the carrier structure may comprise a loose contact as well as a fixed attachment.

The described key assembly provides a nested key arrangement in which one or more flexible arms are used to keep an inner-key in place by first extending below an outer-key and secondly by touching a carrier structure. Flexibility of the arm(s) allows for the necessary movements of the inner-key. A particular advantage of this design is that it can be realized without permanently fixing parts to each other, for example without gluing the inner-key to some carrier web.

The carrier structure may particularly comprise a flexible web or pad that is disposed below the inner-key and the outer-key. Said flexible web or pad may for example consists of rubber or a rubber-like material. The term "web" shall denote—in contrast to a "pad"—a structure that has a plurality of holes or openings. The flexible web or pad provides a base on which the inner-key and the outer-key can be mounted and to which movements of the keys (when operated) can be transferred. Due to the flexible arm of the inner-key, a detachment of said key from the flexible web or pad can be prevented without the necessity to permanently fix (e.g. glue) the inner-key to said web or pad.

According to another embodiment of the invention, the carrier structure may comprise a frame with an opening in which the inner-key and the outer-key are disposed. The frame is preferably solid and usually a part of the housing of the device into which the key assembly is integrated. In contrast to the aforementioned flexible web or pad, the frame usually remains stationary when the keys are operated.

The flexible arm of the inner-key is preferably resilient (elastic). If a distal point of the flexible arm is fixed to the carrier structure, the resilience of the arm allows to hold the inner-key in a resting position when a user exerts no forces on it.

The flexible arm has preferably a curved filamentary shape, for example a C-shape or S-shape. Thus a resilient behavior with well defined characteristics can be achieved without a need to use a particular material. With other words, the whole inner-key can be made of a single material, for example of plastic, while the desired elastic characteristics of the flexible arm can be adjusted as desired via its geometrical layout.

While the invention comprises the case that the inner-key has only a single flexible arm with the described features (extending below the outer-key and touching the carrier structure), it is preferred that it has a plurality of such flexible arms. Most preferably, these flexible arms are arranged symmetrically with respect to a central region of the inner-key. The central region of the inner-key may for example be constituted by a disc-shaped button element, and the flexible arms may be arranged with rotational symmetry around this button element (e. g. with equal angles between two neighboring flexible arms). A symmetrical arrangement of several flexible arms has the advantage that forces exerted by the arms are balanced, thus allowing to hold the inner-key stably in a standard position.

According to another embodiment of the invention, the at least one flexible arm comprises an intermediate "fixing element" that geometrically divides the arm into a "proximal segment" and a "distal segment" (wherein the proximal segment is connected to the part of the inner-key that is operable by a user). Moreover, the fixing element shall be attached to the carrier structure. Due to this attachment, the proximal segment and the distal segment of the flexible arm are substantially decoupled in their movements because the fixing element constitutes a resting node that is fixed to the carrier structure.

According to a further development of the aforementioned embodiment, the distal segment of the flexible arm touches the outer-key. The distal segment thus fixes the inner-key with respect to the outer-key without coupling their movements, because movements are decoupled by the fixing element that is attached to the carrier structure.

In a further embodiment of the invention, the inner-key comprises a "button element" that is operable by a user and a "frame element" that surrounds said button element, wherein the button element is coupled to the frame element by the at least one flexible arm. The frame element hence constitutes a kind of ring that can be attached to the carrier structure and that holds in its central region, via the at least one flexible arm, the button element in a movable position. This embodiment is an example of a design in which the flexible arm touches the carrier structure "indirectly".

The carrier structure may optionally comprise at least one post (protrusion) that extends into a cavity formed in the inner-key or the outer-key. Such an engagement between a post on the carrier structure and a cavity in a key provides additional (positive-locking) means for holding the keys with respect to the carrier structure.

While the key assembly may comprise just two keys, namely the inner-key and the outer-key, it is preferably designed as an assembly of three (or even more) nested keys. In particular, the key assembly may comprise:

A first key.

A second key surrounding the first key.

A third key surrounding the second key (and hence also the first key).

In this nested key arrangement, the intermediate second key may be designed as an "outer-key" with respect to the first key (the latter playing the role of the corresponding inner-key) and as and "inner-key" with respect to the third key (the latter playing the role of the corresponding outer-key), wherein the terms "inner-key" and "outer-key" have the meaning defined above. With other words, the first key comprises at least one flexible arm extending below the second key (and possibly also below the third key), and the second key comprises at least one flexible arm extending below the third key, wherein these arms touch the carrier structure.

The invention further relates to an input device comprising a key assembly of the kind described above, i.e. a key assembly with an inner-key, an outer-key, and a carrier structure, wherein the inner-key comprises at least one flexible arm that extends below the outer-key and that touches the carrier structure. The input device may for example be a remote control, a mobile phone, a music player, a navigation device or the like.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Figure 1:
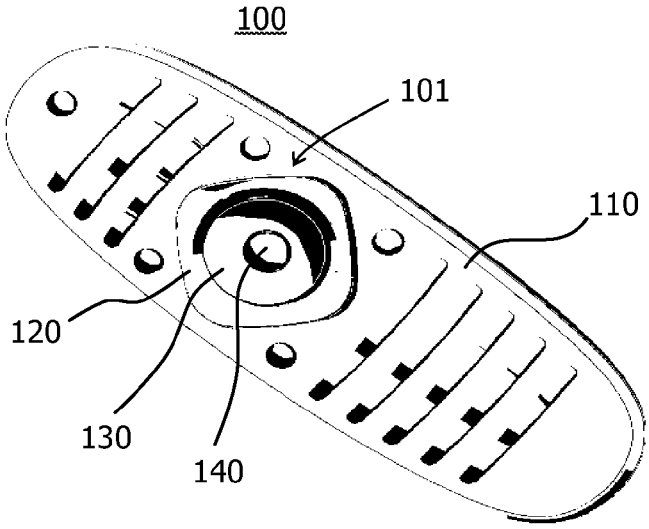
FIG. 1 shows a perspective top view onto a remote control comprising a nested key assembly according to the present invention.

FIG. 1 shows a remote control 100 with a plurality of buttons or keys with hardcap that can be operated (pressed) by a user to control a device like a VCR, a TV apparatus, a CD player or the like (not shown). Besides a plurality of single keys, the remote control 100 comprises a nested key assembly 101 with several independently operable keys arranged in concentric rings. The design of this key assembly 101 and particularly the components that are not visible in the assembled remote control 100 of FIG. 1 will now be described with respect to FIGS. 2-6.

Figure 2:
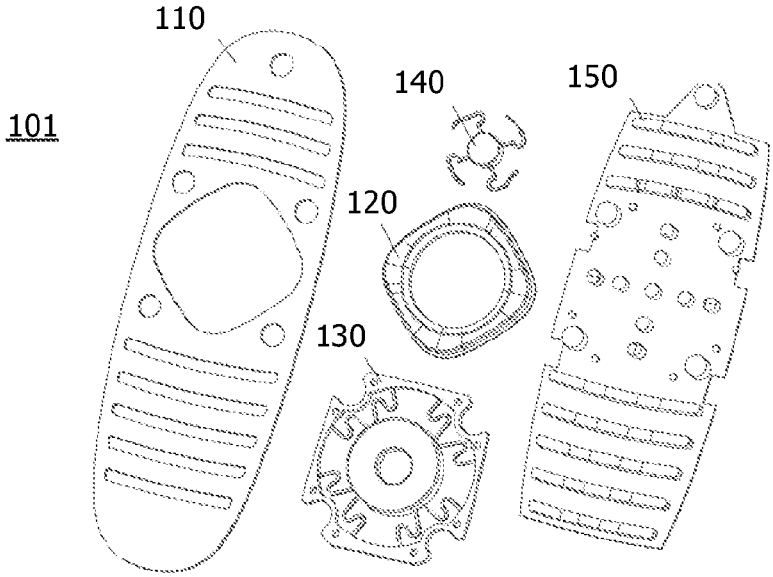
FIG. 2 shows in a perspective top view the separate components of the key assembly of FIG. 1.
Figure 3:
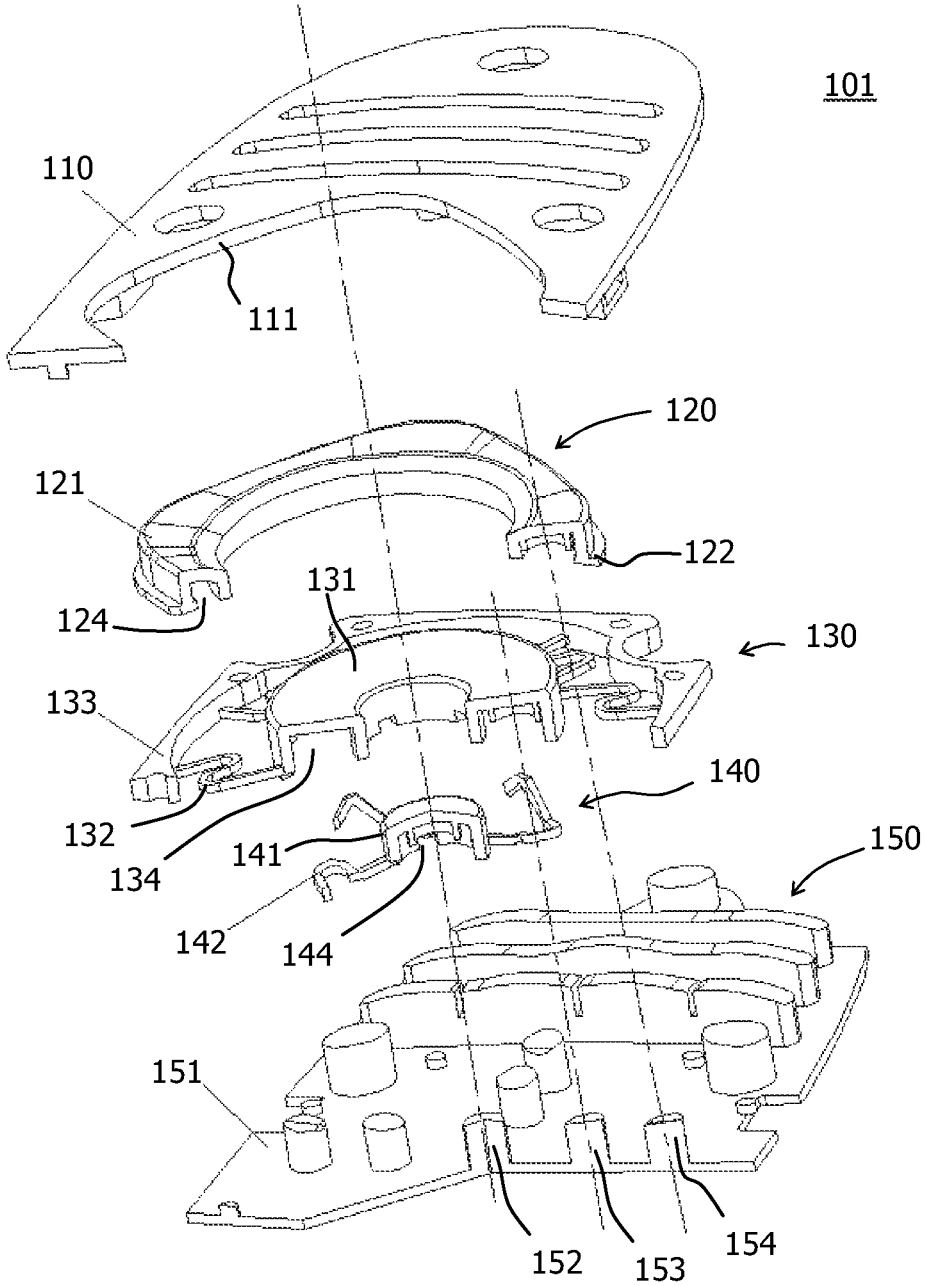
FIG. 3 shows in an exploded view the partially cut components of FIG. 2.
Figure 4:
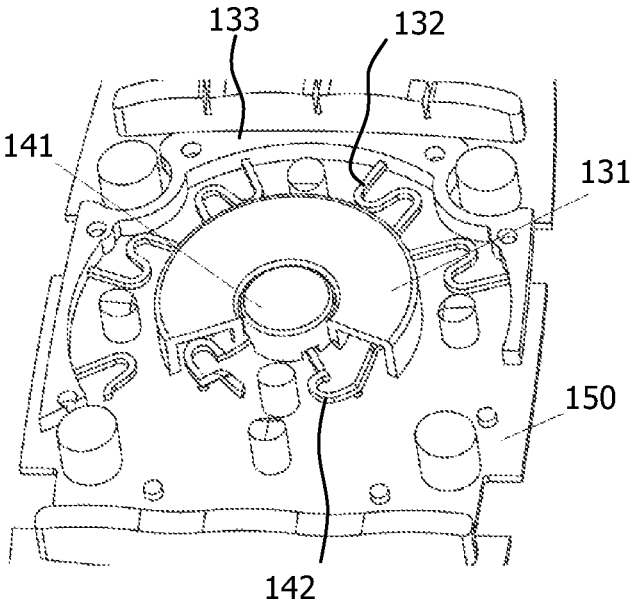
FIG. 4 shows a perspective view of the partially assembled key assembly.

As can be seen from FIGS. 2 and 3, the key assembly 101 comprises the following main components:

A "carrier structure" consisting of a solid frame 110 and a flexible, elastic (rubber-) pad 150. The solid frame 110 typically constitutes a visible component of the assembled device 100, being a part of the housing of this device. The flexible pad 150, on the contrary, constitutes an inner component of the device that is not visible in the assembled state. Moreover, the pad 150 is typically arranged above some circuit board (not shown) comprising the switches and circuits that shall be operated by the keys.

A first key 140, called "OK-key" in the following because it is typically used to confirm selections made by a user in some menu.

A second key 130, called "cursor-key" in the following because it is typically used to move a cursor (pointer) on a screen and/or within a menu. The cursor-key has a central circular opening in which the aforementioned OK-key 140 is arranged (or at least the visible parts of this key).

A third key 120, called "diamond-key" in the following due to its roughly square outer contour and circular inner opening. It is typically used to adjust channel, volume, menu option or return action. The cursor-key is arranged in said circular inner opening.

As can best be seen from FIG. 3, the diamond-key 120 comprises a top side 121 that can be touched by a user and that extends through an opening 111 in the frame 110. The diamond-key 120 further has a flange 122 extending radially outward with a radius larger than the diameter of the opening 111 such that it provides a form-fit of the diamond-key 120 in the opening 111 of the frame 110. Moreover, the diamond-key 120 comprises an annular cavity 124 that is open from its bottom side and into which a post 154 of the flexible pad 150 can engage to additionally hold the diamond-key 120.

The cursor-key 130 has a particular design that makes it an "inner-key" in the sense of the present invention with respect to the diamond-key 120, the latter playing the role of the corresponding "outer-key".

In particular, the cursor-key 130 comprises a central button element 131 that constitutes the part which is operated by a user and which is visible (on its top side) in the assembled device 100. Moreover, the cursor-key 130 comprises a frame element 133 that completely or partly (in alternative embodiments) encircles the button element 131 with an intermediate radial spacing. In the assembled state, the frame element 133 is not visible and fixed between the solid frame 110 and the flexible pad 150.

Finally, the cursor-key 130 comprises a plurality of (in the shown embodiment eight) flexible arms 132 or ribs that are symmetrically distributed around the central button element 131 and that couple this button element to the frame element 133. Due to their filamentary S-shape, the flexible arms 132 are resilient. Hence they allow for a desired movement of the button element 131 against a restoring force which holds it in a resting position with respect to the carrier structure.

The button element 131 of the cursor-key 130 further comprises an annular cavity 134 open from the bottom side which engages with posts 153 on the flexible pad 150 to additionally hold the button element.

The OK-key 140 comprises a circular button element 141 that can be operated by a user. The OK-key 140 has a cavity 144 which is open from the bottom side and which engages with a post 152 on the flexible pad 150 to additionally hold the button element.

Furthermore, the OK-key 140 comprises a plurality of (in the shown embodiment four) flexible arms 142 or ribs that are equally distributed about the circumference of the button element 141.

Figure 5:
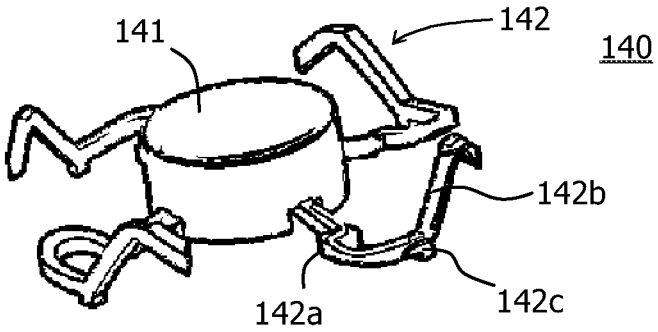
FIG. 5 shows an enlarged view of the OK-button.
Figure 6:
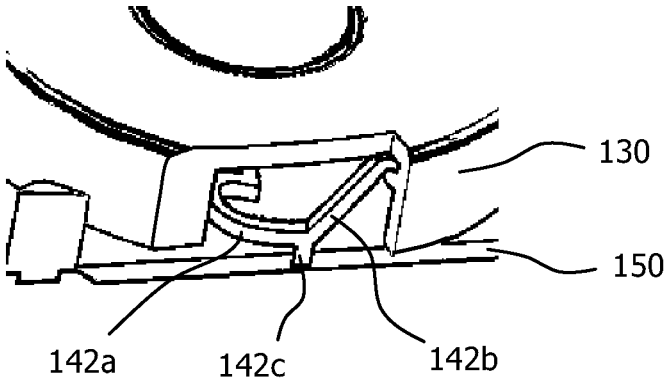
FIG. 6 shows in an enlarged, partially cut view the mounted OK-button.

As can best be seen from FIGS. 5 and 6, the flexible arms 142 of the OK-key 140 comprise a fixing element 142*c*, i.e. a small post or boss extending downwardly.

In the assembled state (FIG. 6), the fixing element 142*c* engages into a hole in the flexible pad 150. The fixing element 142*c* thus geometrically and functionally divides the corresponding flexible arm 142 into a proximal segment 142*a*, located between the fixing element 142*c* and the button element 141, and a distal segment 142*b*.

The proximal segments 142*a*, which are roughly C-shaped, hold the button element 141 resiliently in place with respect to the flexible pad 150.

The distal segments 142*b*, on the contrary, are substantially decoupled from any movement of the button element 141 due to the fixation of the intermediate fixing element 142*c*. The distal segments 142*b*, which are also roughly C-shaped and hence resilient, touch the button element 131 of the cursor-key 130. This prevents a detachment of the fixing element 142*c* from the pad 150 and thus holds the OK-key 140 in place. Due to their elasticity, the distal segments 142*b* do not hinder the movement of the cursor-key 130 but rather contribute to appropriate elastic restoring forces acting on this key. Movements of the cursor-key 130 are however not carried forward to the OK-key 140 because they are neutralized at the fixing element 142*c*.

In summary, the present invention provides for the following devices:

(i) An "OK-key" assembly comprising:

an OK-key and a flexible arm, wherein the flexible arm has effectively a spring function;

a fixing element (boss) at the underside of the flexible arm locking to an underneath part (typically to a hole in a key-mat);

a top side of the flexible arm to prevent upwards movement by another part on top;

wherein a downward movement by the part on top will not cause the OK-key being depressed as said movement is annulled by the boss contact and locking.

(ii) A "cursor-key" assembly comprising:

a cursor-key with a flexible arm and a frame element;

wherein the flexible arm allows the cursor-key to be connected to the frame element in a flexible manner and holds it in place, having effectively a spring function;

wherein said spring function enables a downwards movement of the cursor-key and causes the cursor-key to return to its original position after a key-press;

(iii) A combination of the OK-key assembly and the cursor-key assembly.

Advantages achieved by the design of the present invention comprise:

that a key is fully locked in position on both bottom and top side by the flexible arms (preventing "rattling" of the key);

that no glue is needed (instead the flexible arms are used);

a simpler and cheaper assembly is achieved while keeping good touch and feel.

The invention can favorably be applied in key assemblies in which nested keys with hard caps are needed, such as in remote controls and other hard-key based input devices.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A nested key assembly comprising:

a first key;

a second key surrounding the first key;

a third key surrounding the second key;

an inner-key which is operable by a user from a top side;

an outer-key which is operable by a user from the top side and which at least partially surrounds the inner-key; and a carrier structure;

wherein the inner-key comprises at least one flexible arm that extends below the outer-key and that directly or indirectly touches the carrier structure, the flexible arm comprises an intermediate fixing element that divides the arm into a proximal segment and a distal segment and that is coupled to the carrier structure, and the second key is the outer-key with respect to the first key and the inner-key with respect to the third key.

2. The key assembly according to claim 1, characterized in that the carrier structure comprises a flexible web or pad that is arranged below the inner-key and the outer-key.

3. The key assembly according to claim 1, characterized in that the carrier structure comprises a frame with an opening in which the inner-key and the outer-key are arranged.

4. The key assembly according to claim 1, characterized in that the flexible arm is resilient.

5. The key assembly according to claim 1, characterized in that the flexible arm has a curved filamentary shape.

6. The key assembly according to claim 1, characterized in that the inner-key comprises a plurality of such flexible arms that are arranged symmetrically with respect to a central region of the inner-key.

7. The key assembly according to claim 1, characterized in that the distal segment touches the outer-key.

8. The key assembly according to claim 1, characterized in that the inner-key comprises a button element operable by a user and a frame element surrounding the button element, wherein the button element is coupled to the frame element by the at least one flexible arm.

9. The key assembly according to claim 1, characterized in that the carrier structure comprises at least one post that extends into a cavity of the inner-key or the outer-key.

10. An input device comprising a key assembly according to claim 1.

* * * * *